US007207538B2

(12) United States Patent
Kent-Fawkes

(10) Patent No.: US 7,207,538 B2
(45) Date of Patent: Apr. 24, 2007

(54) PLASTIC BEVERAGE BOTTLE HOLDER

(76) Inventor: Rod Kent-Fawkes, 380 Buss Avenue, Parksville, British Columbia (CA) V9P 1L6

( * ) Notice: Subject to any disclaimer, the term of this patent is extended or adjusted under 35 U.S.C. 154(b) by 0 days.

(21) Appl. No.: 10/914,183

(22) Filed: Aug. 10, 2004

(65) Prior Publication Data

US 2005/0017145 A1 Jan. 27, 2005

Related U.S. Application Data

(63) Continuation-in-part of application No. 10/338,114, filed on Jan. 9, 2003, now abandoned.

(51) Int. Cl.
*A47G 23/02* (2006.01)

(52) U.S. Cl. ..... 248/311.2; 248/145.6; 220/741; 294/33; 215/395

(58) Field of Classification Search ..... 248/311.2, 248/309.1, 313, 689, 145.6; 294/28, 29, 294/33; 16/425; 220/737, 759, 769, 741; 215/395; D7/622

See application file for complete search history.

(56) References Cited

U.S. PATENT DOCUMENTS 1,702,555 A * 2/1929 Watson ..... 248/145.6
2,029,051 A * 1/1936 Blevins ..... 294/33
2,088,387 A * 7/1937 Rice, Jr. et al. ..... 215/395
2,116,148 A * 5/1938 Hawley ..... 248/145.6
2,784,578 A * 3/1957 Southwick ..... 220/741
3,021,026 A * 2/1962 Clare ..... 215/395
3,189,937 A * 6/1965 Sciortino ..... 294/33
3,458,164 A * 7/1969 Massey ..... 248/145.6
4,120,073 A * 10/1978 Studebaker ..... 294/33
4,486,043 A * 12/1984 Rais ..... 294/27.1
4,898,297 A * 2/1990 Wheeler ..... 220/742
4,993,675 A * 2/1991 Walker ..... 248/311.2
5,013,074 A * 5/1991 Galle ..... 294/33
5,025,940 A * 6/1991 Akly ..... 215/395
D329,517 S * 9/1992 Vavla ..... D7/622
5,183,169 A * 2/1993 Grzych ..... 215/395
5,335,954 A * 8/1994 Holub et al. ..... 294/31.2
D359,657 S * 6/1995 Davidson et al. ..... D7/622
5,558,240 A * 9/1996 Karp ..... 215/398
6,003,205 A * 12/1999 Dehaven ..... 16/425
6,651,838 B2 * 11/2003 Bissell ..... 220/741

* cited by examiner

*Primary Examiner*—Anita M. King
(74) *Attorney, Agent, or Firm*—J. Gordon Thomson

(57) ABSTRACT

A beverage bottle holder is adapted to hold a plastic beverage bottle and comprises a bottom collar adapted to accept the bottom surface of the beverage bottle; a top grasping member adapted to exert compressive forces against the outside surface of the beverage bottle to firmly holding the bottle in a stable configuration within the bottle holder; a handle and at least one sinusoidal cusp within the inner surface of the bottom collar. The cusp is adapted to mesh with concavities within the bottom of the plastic bottle. The bottle holder is specifically designed for use in combination with plastic beverage bottles by persons with reduced hand strength and motor skills due to age, infirmities and disease.

20 Claims, 13 Drawing Sheets

PLASTIC BEVERAGE BOTTLE HOLDER

CROSS REFERENCE TO RELATED APPLICATIONS

This application is a Continuation-in-Part related to my application 10/338,114 filed on Jan. 9, 2003 and expressly abandoned.

BACKGROUND OF THE INVENTION

1. Field of the Invention

This invention relates to the field of hand manipulated devices and more specifically a handling device adapted for holding plastic bottles particularly for containing beverages.

2. Discussion of the Prior Art

There are many infirmities related to aging, injury and disease which result in a reduction of motor skills and limb strength particularly in the arms and hands. For example, arthritis, carpel tunnel syndrome, muscular dystrophy and injury induced paralysis often restrict the ability of individuals to grasp and firmly hold objects such as smooth surfaced bottles containing soft drinks, water or milk. Furthermore, the height, considerable diameter and weight of containers, such as 1, 1.5 and 2 liter-sized plastic beverage bottles, make it difficult for weakened individuals to manipulate such bottles safely.

The prior art discloses a number of devices that are designed to aid individuals to grasp, lift and carry beverage bottles, beverage cans and like containers. Examples include U.S. Pat. No. 5,806,904 "Bottle Lifting Device" issued to Smith on Sep. 15, 1998; U.S. Pat. No. 5,695,232 "Bottle Carrier" issued to Tipp on Dec. 9, 1997; U.S. Pat. No. 5,183,169 "Reusable Bottle Handle" issued to Grzych on Feb. 2, 1993; and, U.S. Pat. No. 6,378,924 "Reusable Bottle Holder" issued to McCumb on Apr. 30, 2002. However, all of these devices are not well adapted for use by persons who have diminished strength and motor skills due to age, injury or disease. Furthermore, these devices do not facilitate the safe manipulation of large plastic beverage bottles by such persons.

Therefore, there continues to be a need for a beverage bottle holder that is able to conveniently hold and permit carriage and manipulation of a large plastic beverage bottle by an individual with reduced or weakened hand strength.

OBJECTS OF THE INVENTION

It is a principle object of the present invention to provide a beverage bottle holder that overcomes the deficiencies noted above.

Another object of this invention is to provide a beverage bottle holder that is specifically designed for individuals that have reduced hand strength due to age, injury or disease.

It is a further object of the invention to provide a beverage bottle holder that is comfortable and safe to use by persons with weakened hand strength.

It is yet another object of the invention to provide a beverage bottle holder that is lightweight, easy to manufacture and inexpensive to purchase.

SUMMARY OF THE INVENTION

The invented beverage bottle holder is designed for use with a plastic beverage bottle having a bottom comprising a plurality of evenly cusped configurations constituted by inward wall portions and outwardly projecting wall portions. These inward and outward portions form inward sloping legs.

The holder comprises a base adapted to accept and firmly seat the bottom of the bottle. The base comprises a collar having an annulus, a height, an inside wall, an outside wall, a flat top surface and a flat bottom surface; at least one sinusoidal cusp projecting radially inwards from the collar inside wall; a first pivot point; and; a second pivot point. The holder also comprises two arcuate arms for firmly grasping the bottle within the bottle holder and a handle.

The collar annulus has a bottom inside diameter and a top inside diameter. The bottom inside diameter is less than the top inside diameter causing the collar outside wall to have a slope of 45 degrees or less. The collar inside wall has an inward sloped portion and a vertical portion. The collar inside wall includes at least one sinusoidal cusp projecting radially inwards. The cusp has a flat bottom surface, a flat top surface and a height equal to the collar height. The cusp meshes with at least one of the inward wall portions on the bottom of the bottle thereby preventing rotation of the bottle within the holder. In another embodiment of the invention, collar has a plurality of sinusoidal cusps. In yet another embodiment, collar has as many sinusoidal cusps as the bottle has inward wall portions.

In order to facilitate a controlled pouring operation by a person with weakened hand strength, there is a first pivot point located at the junction of the front of the flat bottom surface of the collar and the front bottom end of the collar outside wall and a second pivot point is located at the front top of the collar outside wall. The first pivot point is adapted to pivot, on a flat stable surface such as a table top, the bottle holder Y-axis from a first vertical position to a second position wherein the bottle holder Y-axis is at an angle of no more than 45 degrees from the vertical. The second position is an intermediate stable position whereby the bottle is resting on the flat front of the outside wall of the collar. The second pivot point is adapted to pivot the bottle holder Y-axis from said second position to a pouring position.

The grasping arcuate arms are formed from an open ring having a gap, a back end fixed to the handle top end and an inside diameter. The arms have an inherent resiliency so that when the bottle is placed within the ring the arms will have an inherent tendency to flex outwardly to accommodate the slightly larger diameter of the bottle and subsequently exert a compressive force against the outside surface of the bottle thereby firmly grasping it. The arms each include a pair of raised parallel contact surfaces molded on their inside surfaces.

BRIEF DESCRIPTION OF THE DRAWINGS

The foregoing and other objects, features and advantages of the invention will be apparent from the following more particular description of the preferred embodiments of the invention as illustrated in the accompanying drawings in which like reference characters refer to the same parts throughout the different views. The drawings are not necessary to scale, emphasis instead being placed upon illustrating the principles of the invention.

DETAILED DESCRIPTION OF THE PREFERRED EMBODIMENT

Figure 1:
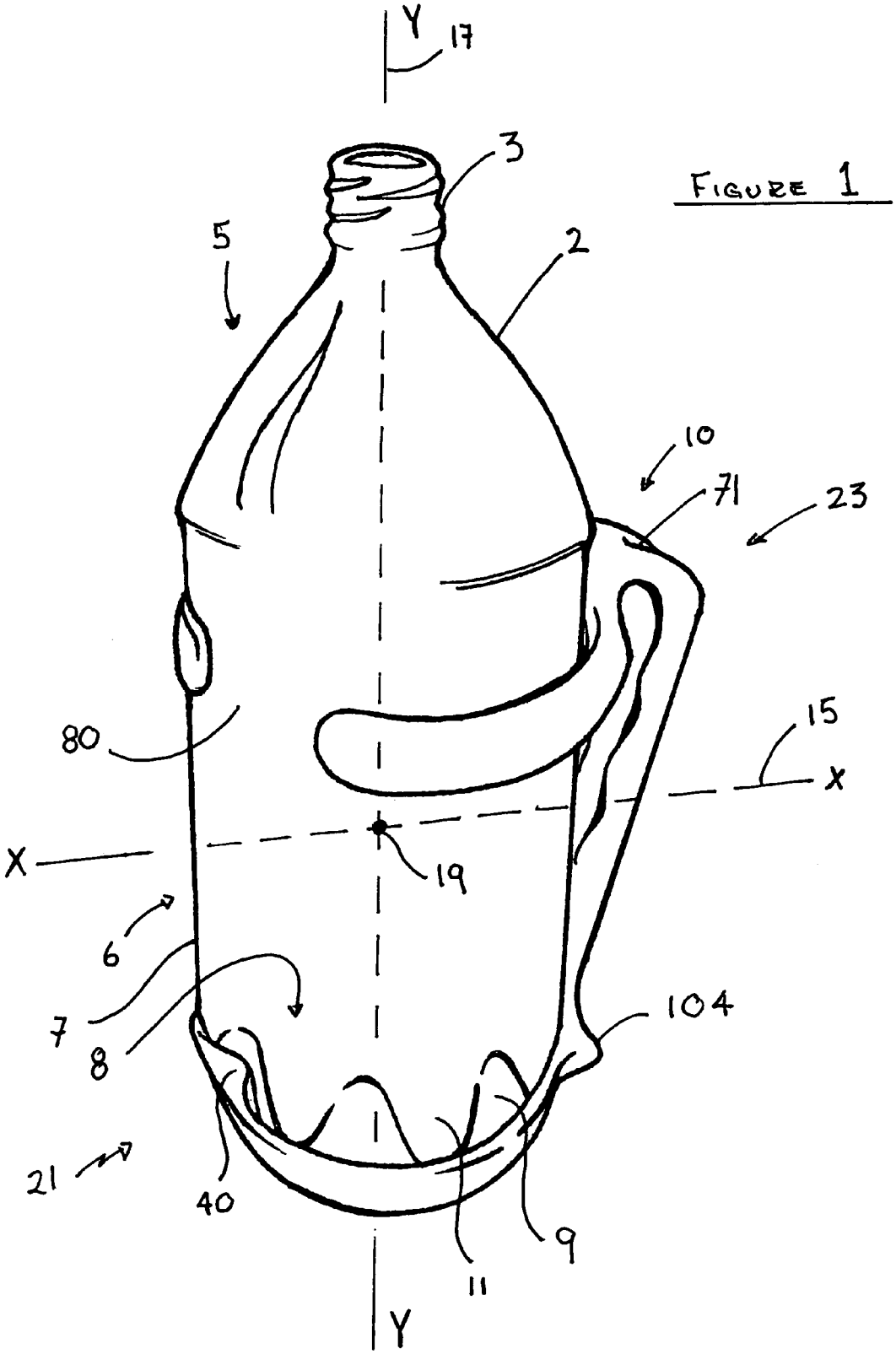
FIG. 1 is a view of one embodiment of the invention shown in combination with a plastic beverage bottle.

Referring to FIG. 1, there is a perspective front view of one embodiment of the invention (10), being a beverage bottle holder shown in combination with a typical plastic beverage bottle (2). For orientation purposes, there is shown an X axis (15) and a Y axis (17) through the bottle centre of gravity (19). The bottle also has a front (21) and a back (23). For example, sinusoidal cusp (40) and gap (80) are front facing and chin (104) and notch (71) are back facing. X-axis (15) also runs through the invented bottle holder front to back.

The bottle may have any volume but generally the size of bottle contemplated by this invention is between 1 and 2 liters. The invented holder may be sized to accommodate such bottles. The holder can be dimensioned for any sized plastic bottle of the type contemplated herein. Typically, a plastic beverage bottle (2) is adapted to contain either pressurized or non-pressured beverages such as sparking water, carbonated soft drinks or mineral water. The bottle (2) typically has a neck portion (3), a shoulder portion (5), and a body portion (6) with sidewall (7) and a bottom portion (8). The bottom portion (8) blends smoothly into the sidewall (7). The bottom portion (8) is adapted to resist deformation caused by bulging outward and therefore comprises a plurality of evenly cusped configurations constituted by inward wall portions (9) and outwardly projecting wall portions in the form of legs (11). The legs (11) are inwardly sloping and generally taper downwards and inwards and include bottom pads (not shown) on which the bottle will rest upright.

Figure 2:
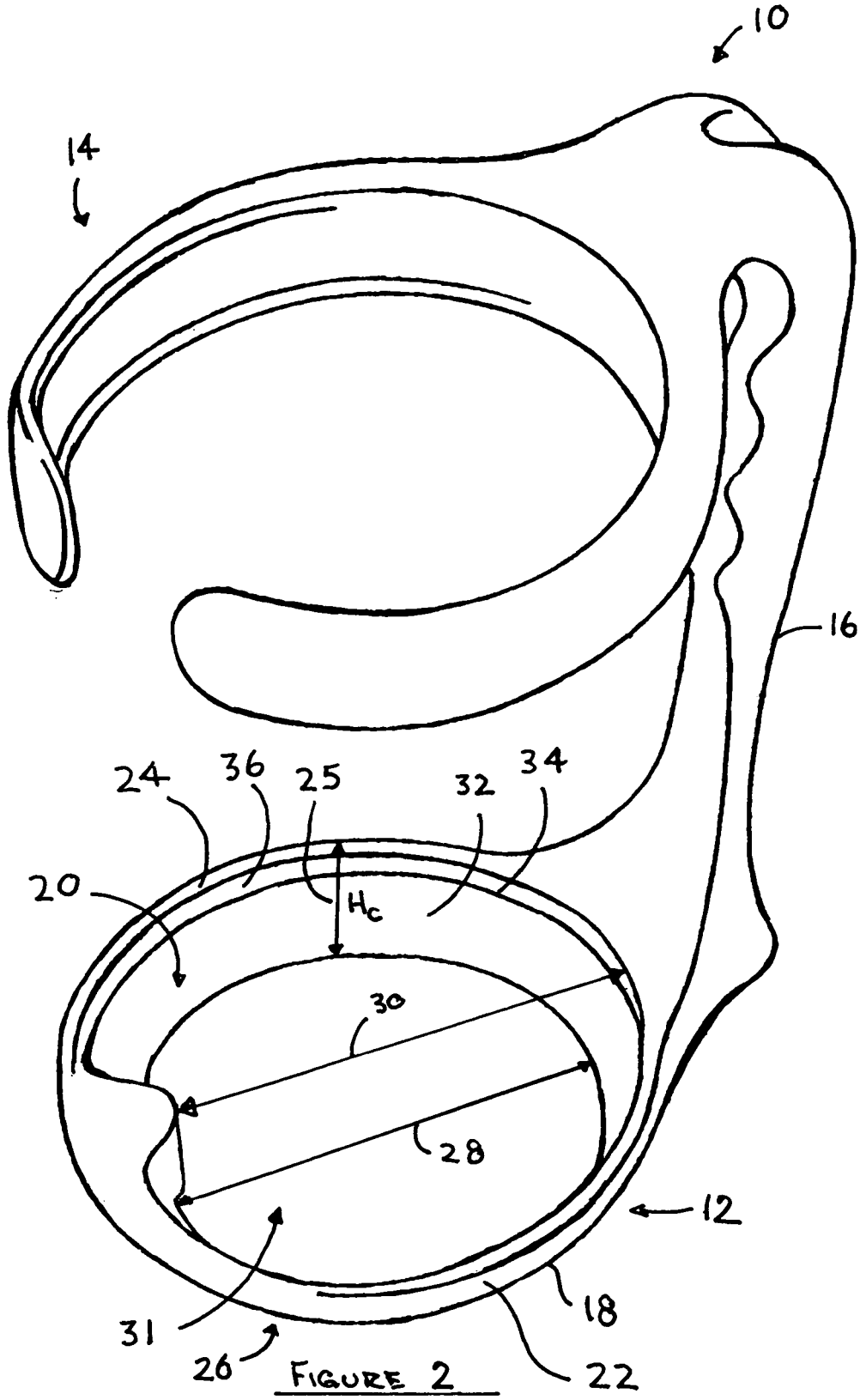
FIG. 2 is a view of another embodiment of the invention without a plastic beverage bottle.

Referring now to FIG. 2, the bottle holder (10) is shown separated from the bottle (2). The bottle holder is adapted to securely grasp and hold a plastic beverage bottle in order to meet the objectives of the invention. The preferred embodiment of the bottle holder shown in FIG. 2 comprises a base (12) adapted to securely seat the bottom of the bottle therein, bottle grasping means (14) adapted to firmly grasp the bottle and hold it within the invention and a handle (16) disposed between and connecting together the bottle grasping means (14) and base (12).

Still referring to FIG. 2, the base comprises a collar (18) having a bottom annulus (31), a collar inside wall (20), an outside wall (22), a top surface (24) and a bottom surface (26). The collar has a height (25) indicated as H.sub.C. Top surface (24) is flat. Bottom surface (26) is also flat and provides overall 360 degree stability about the Y axis (17) of the invention when holding a plastic beverage bottle as depicted in FIG. 1. Bottom annulus (31) has a first bottom inside diameter (28) and a second top inside diameter (30). Collar Inside wall (20) has a first inward sloped portion (32) that commences at bottom surface (26) and slopes upwards to a line (34) just below the top surface (24) of the collar. The collar inside wall (20) includes a second vertical portion (36) tat commences at line (34) and terminates at the top surface (24) of the collar (18). The sloped portion (32) of collar inside wall (20) is adapted to receive the downward and inward sloping legs (11) on the bottom portion of a plastic beverage bottle in a contacting relationship, that is, the outside surface of the bottle legs (it) bear against the sloped inside surface of the collar inside wall (20) resulting in carriage of the weight of the upright bottle by the collar (22). The vertical portion (26) (36) acts to guide the bottom of the bottle into the sloped portion (32) of the collar.

Figure 3:
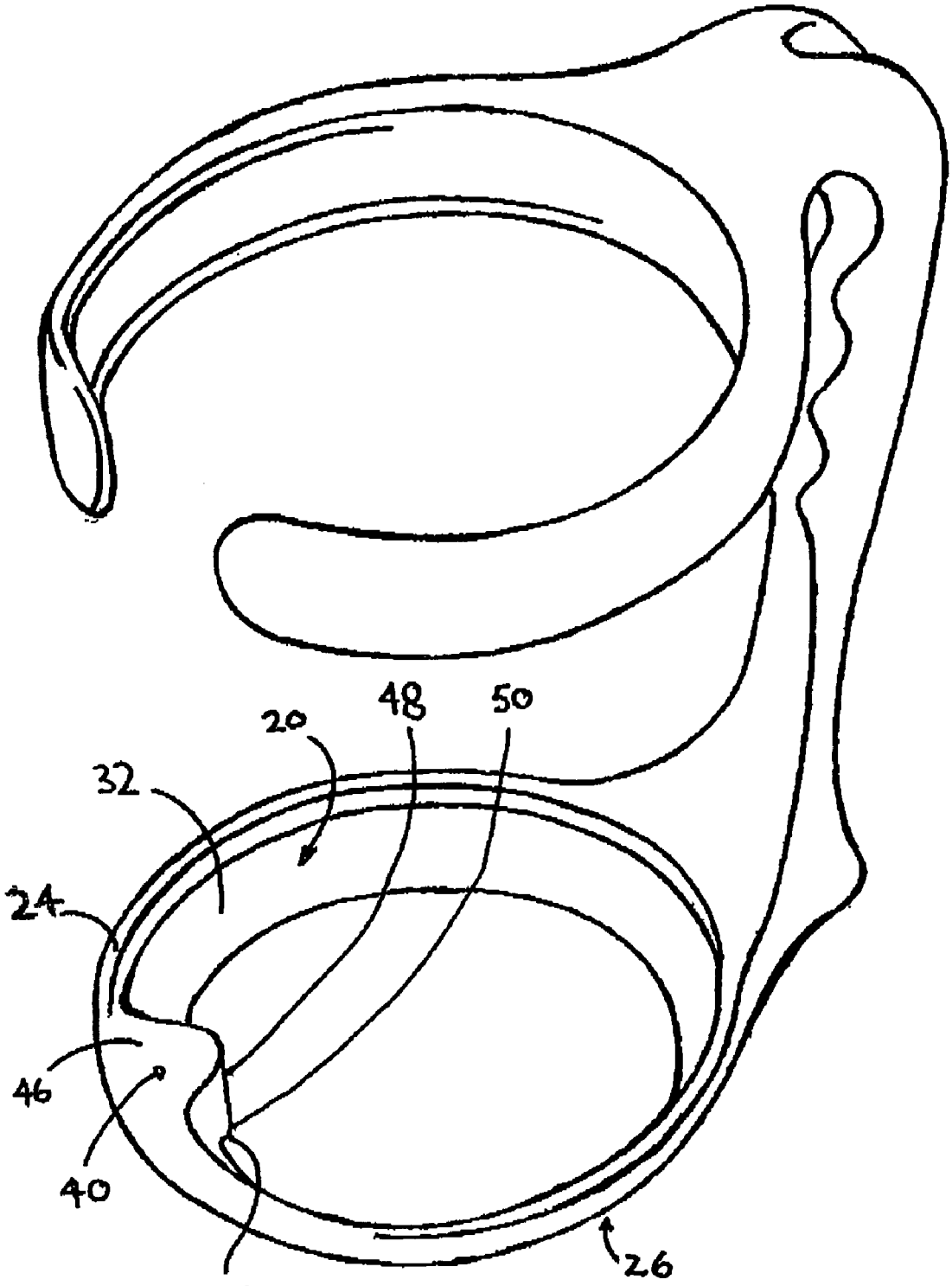
FIG. 3 is the same view as FIG. 2 emphasizing the cusp of the invention.

Referring now to FIG. 3, the surface of the collar inside wall (20) is interrupted by at least one sinusoidal cusp (40) projecting radially inwards from the collar inside wall. The cusp is cohesive to the collar inside wall and has a flat bottom surface (44) contiguous with bottom surface (26) and a flat top surface (46) contiguous with flat top surface (24). Due to the sloped portion of the collar inside wall (32) the crest (48) of the cusp (40) is higher than the crest (50) of the bottom surface (44) of the cusp. The height of the cusp of the cusp is equal to the height of the collar.

Figure 2A:
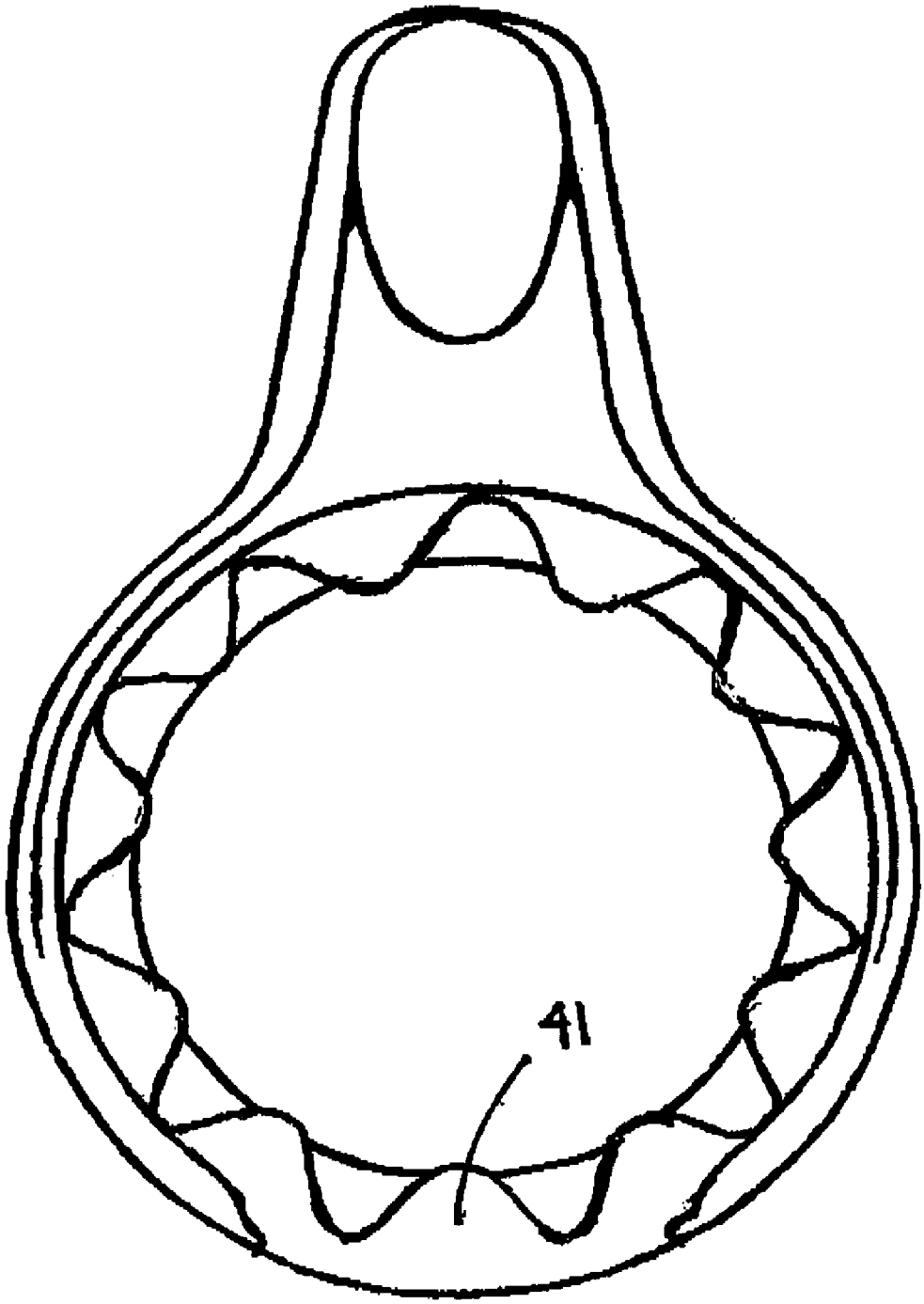
FIG. 2*a* is a view of one embodiment of the invention with a plurality of cups.

Referring now to PIG. 1 and FIG. 2, and as previously described, the legs at bottom of the water bottle includes inwardly sloping legs (11) and inward-sloped wall portions (9). The crest of cusp (40) has a slight slope angle that approximates the inward slope of wall portions (9) on the bottle. The height and width of cusp (40) approximates the depth and width of the inward sloping wall portions (9) on the bottle (2). As a consequence, when the bottle is seated within the collar (18) the at least one cusp (40) will mesh with at least one of the inward sloping wall portions (9) between legs (11). It follows that rotation of the bottle around the Y axis will be inhibited by the locking action of the cusp meshed within the concavity (9) created by the inward sloping wall portions on the bottom of the bottle. While the invention has been described with reference to at least one cusp (40) one skilled in the art will appreciate that there may be a plurality of cusps distributed radially and symmetrically about the inside surface of the collar (18) adapted to mesh with a plurality of concavities located on the bottom of the bottle. This is illustrated in FIG. 2*a* with a nluralitv of cusps shown as item (41). The invention is able to be dimensioned so that a bottle holder for a 1 liter bottle will include sufficient cusps adapted to mesh with all of the concavities on such a bottle. Provisions can be similarly made for 1.5 liter and 2 liter bottles.

The importance of restraining the rotation of the bottle seated within the collar cannot be underestimated. When the bottle and holder combination are stored in a refrigerator, there may be condensate on the outside bottom surface of the bottle which could act as a lubricant and facilitate rotation of the bottle within the holder. Upon inspection of FIGS. 5, 6 and 7 it will be seen that placing the hand in the slide grip manner illustrated could cause the bottle to rotate and cause the hand to slip. Such a result may be tolerable for a healthy individual with strong hands but for a person with weakened hand strength and lessened motor skills, rotation of the bottle during tipping and pouring as illustrated could result in a loss of control of the bottle and holder and an accident. Therefore, the inclusion of the at least one sinusoidal cusp (40) on the inside wall of the collar acts to prevent rotation during accident prone operations such as tipping and pouring contents from the bottle.

Figure 4:
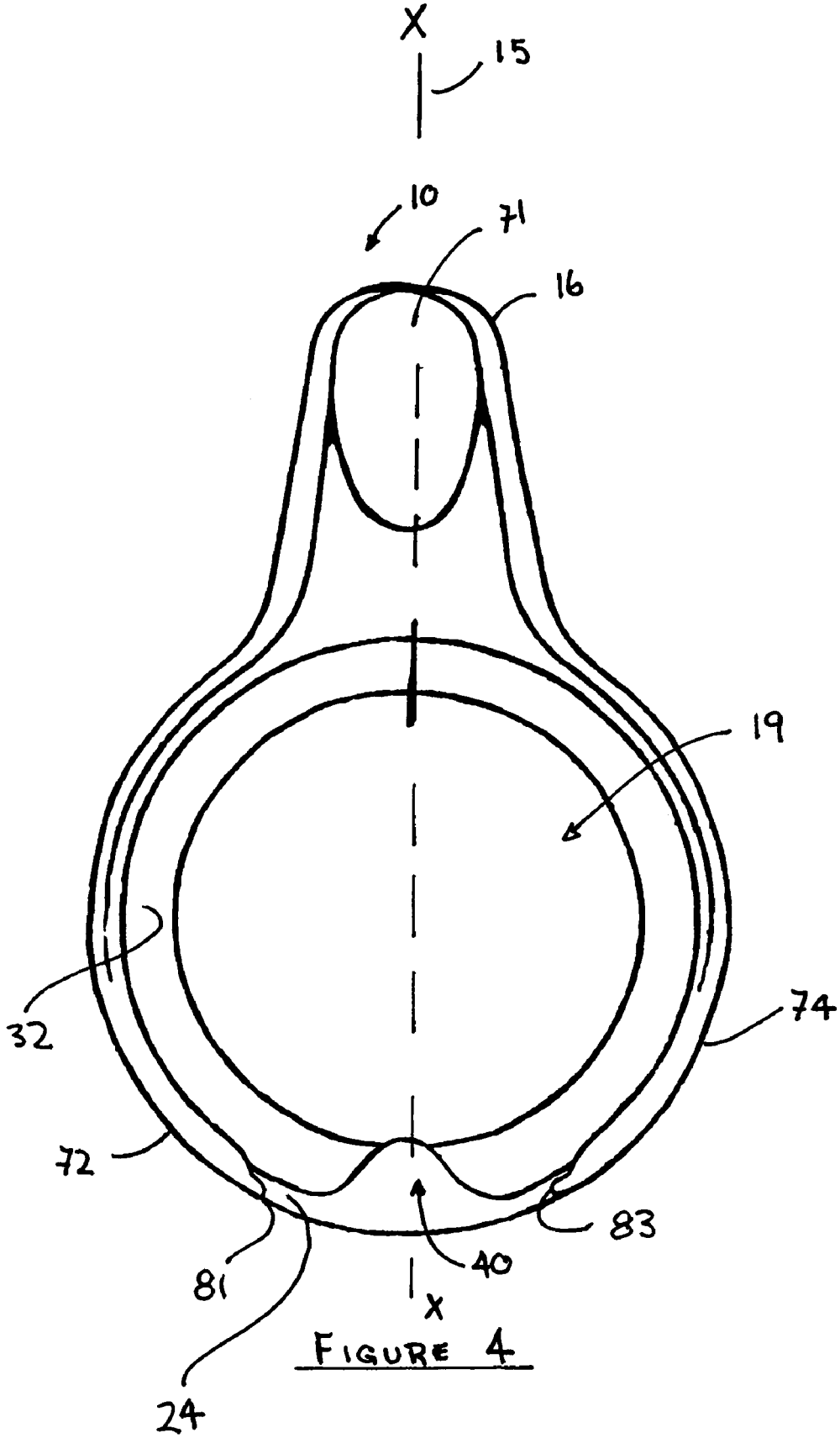
FIG. 4 is a top view of one embodiment of the invention.

Referring now to FIG. 4, there is shown a top view of one embodiment of the invented bottle holder showing annulus (19). X axis (15) is show orientation through notch (71) and cusp (40). Grasping arms (72) and (74) with tips (81) and (83) respectively are illustrated and discussed more fully below. Collar inside wall sloped portion (32) is illustrated as is collar top surface (24). Handle (16) is also illustrated.

Figure 5:
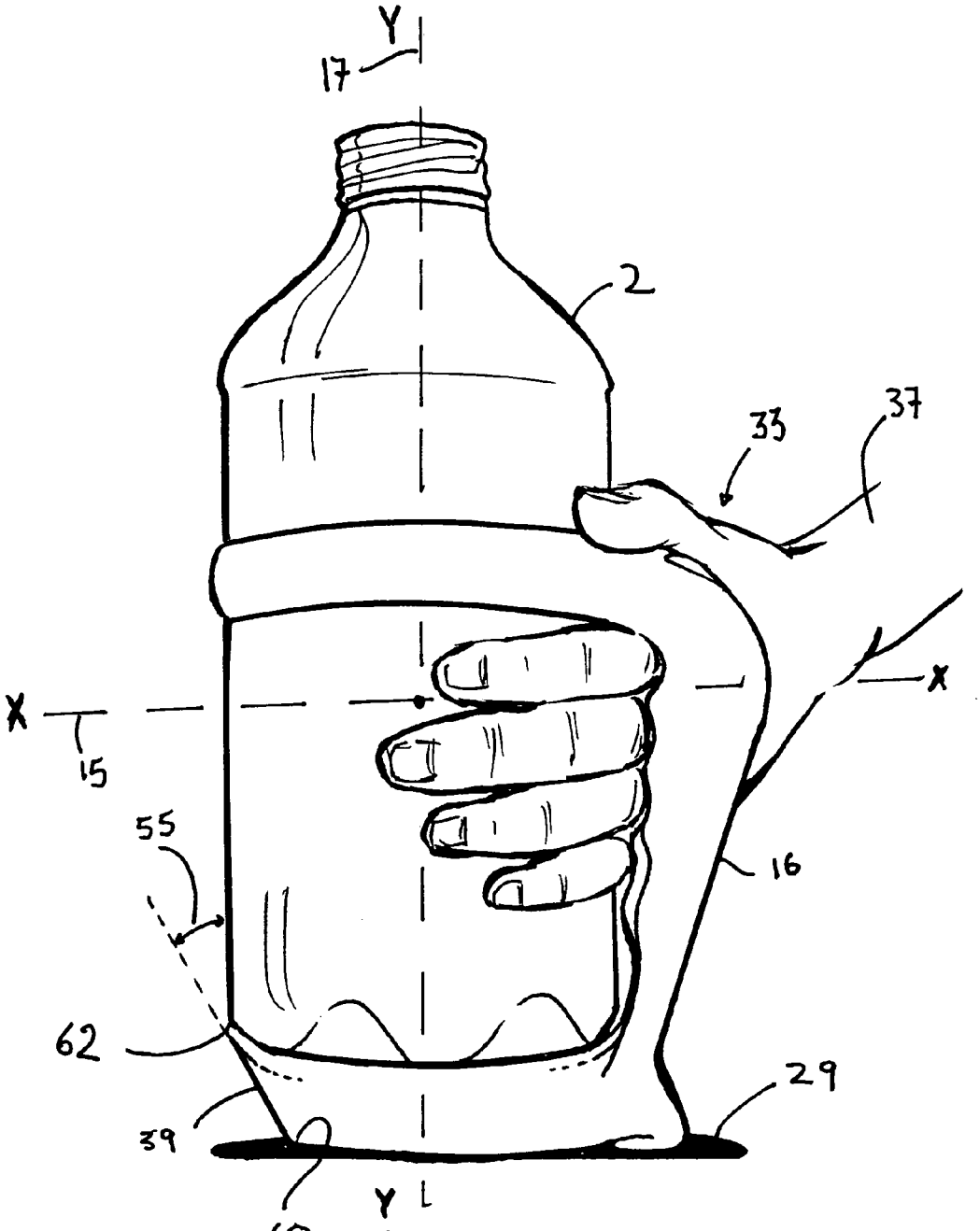
FIG. 5 is a side view of one embodiment of the invention with a plastic beverage bottle contained therein in a vertical position with the hand in a slide grip position.
Figure 6:
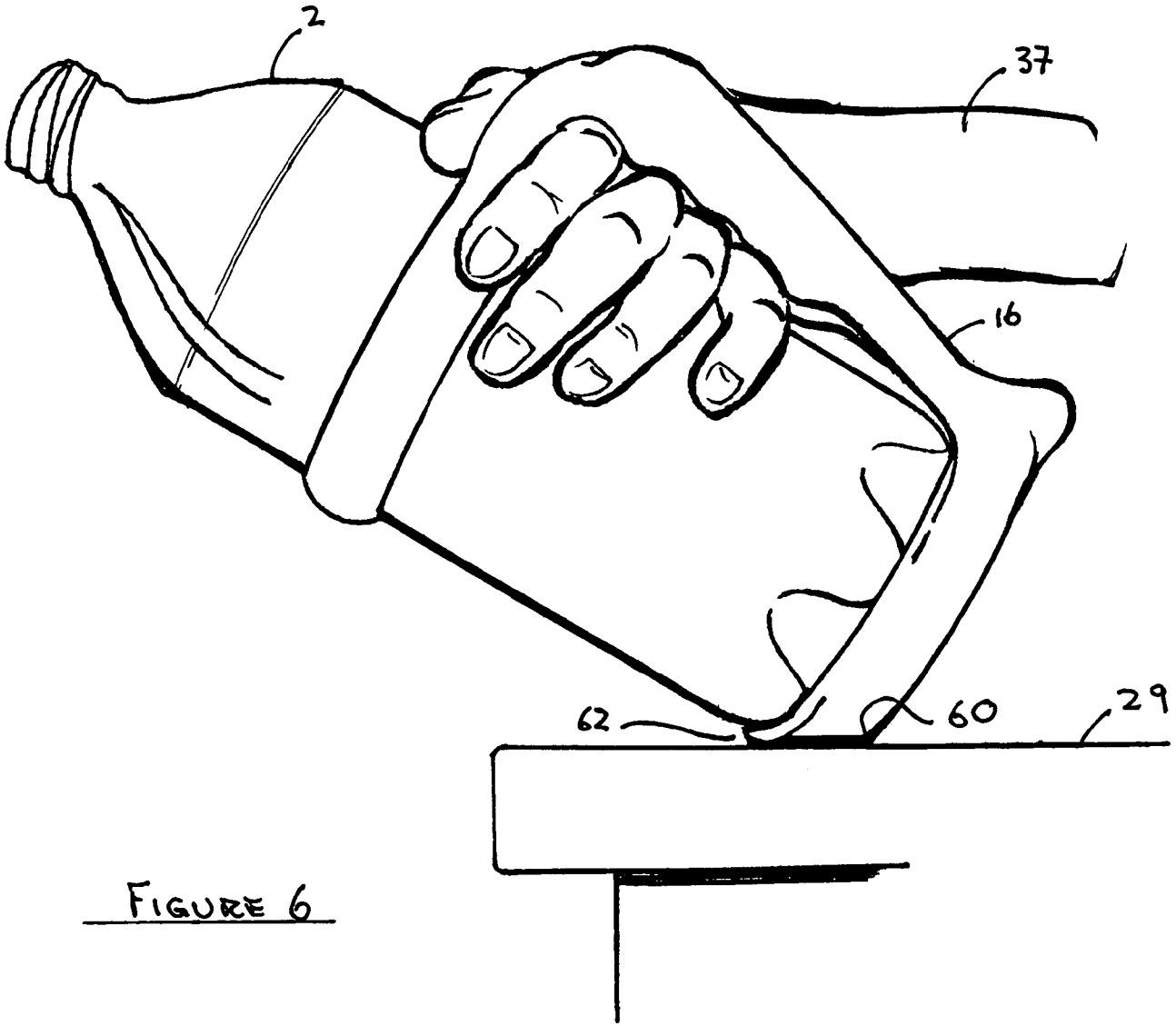
FIG. 6 is a side view of the same embodiment as FIG. 5 showing the combined beverage bottle holder and bottle after having pivoted about a first pivot point with the hand in a slide grip position.
Figure 7:
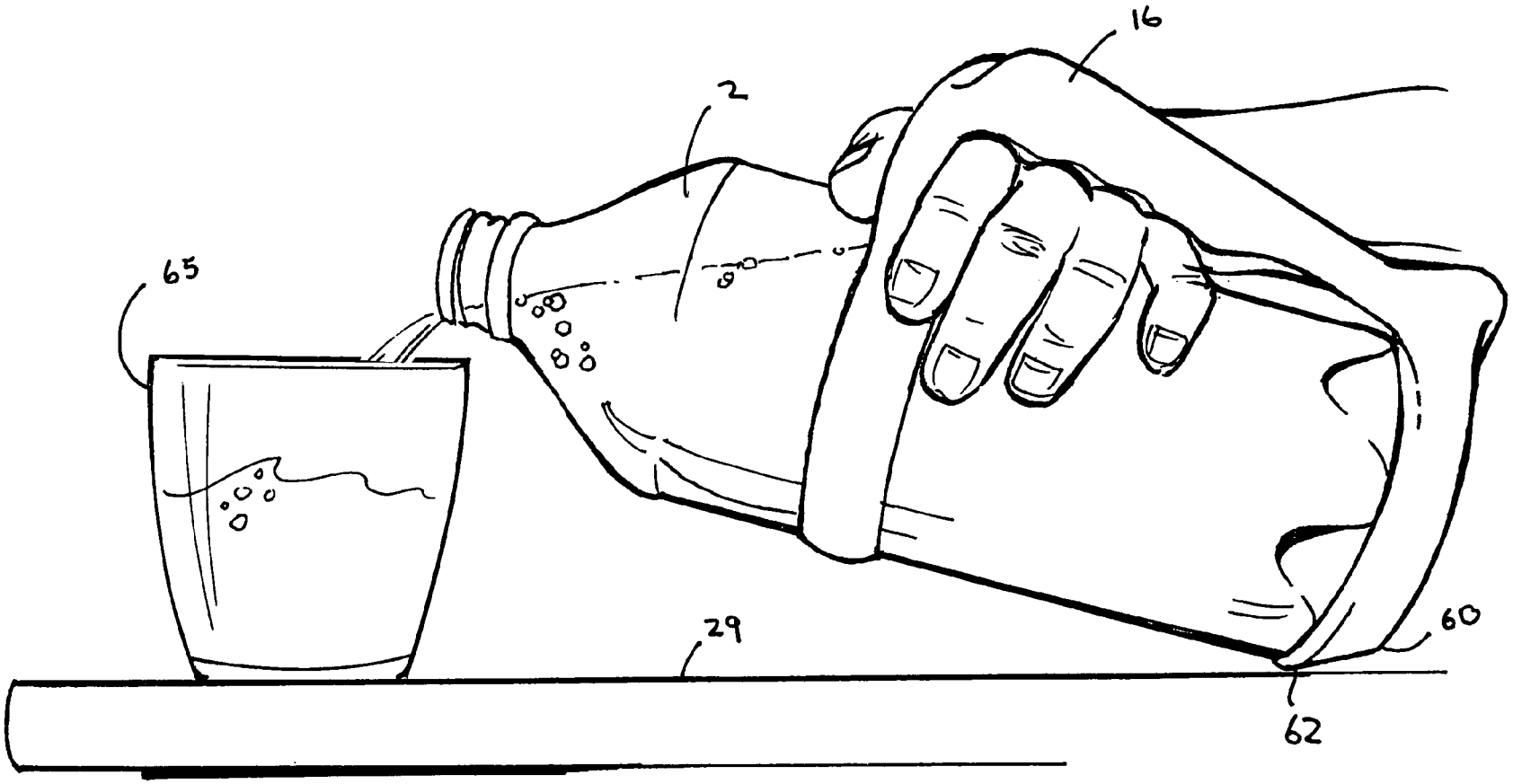
FIG. 7 is a side view of the same embodiment as FIGS. 5 and 6 showing the combined beverage holder and bottle pivoting about a second pivot point with the hand in a slide grip position.

Referring now to FIG. 5, there is shown the invented bottle grip in combination with a plastic beverage bottle resting on a surface (29). The hand (33) is inserted between the handle (16) and the bottle (2) in a slide-grip fashion. The slide-grip is wed when the individual does not have the hand strength or motor skills necessary to firmly grasp the handle in a pistol-grip fashion. The weight of the bottle holder and bottle combination is balanced on the dorsal side of the hand as illustrated in FIGS. 6 and 7 and the force required to move the bottle bolder and bottle combination from a vertical position to a pouring position and back to a vertical position can be provided by the arm (37) and shoulder. In FIG. 5, the front outside wall (39) Of the collar (20) is linear and has a slope angle (55) that facilitates tipping the bottle holder and bottle combination forwards along the negative X axis (15) in order to pour the contents of the bottle into a receptacle. FIGS. 5, 6 and 7 show the action of a first pivot point (60) and a second pivot point (62) creating a two-step pouring process which permits easy control of the bottle holder and bottle combination by a person with reduced hand strength. The first pivot point (60) and the second pivot point (62) are located at the top and bottom of the front outside wall (39) of collar (20). First pivot point (60) is located at the bottom of the front outside wall (39) and second pivot point (62) is located at the top of the front outside wall (39). FIGS. 5, 6 and 7 show a step-wise pouring process that takes advantage of the two pivot points. In FIG. 5, the borne is in a vertical position within the bottle bolder resting on surface (29). The person engages the combination in a slide-grip fashion by placing a hand (33) between the bottle (2) and the bottle holder (10). In FIG. 6, the individual pushes the combination forward about the first pivot point (60) to a first tilt position where the combination finds a stable intermediate position on the front flat surface (39). The first pivot point (60) is adapted to pivot the bottle from the first vertical position to the second intermediate stable position where the bottle Y-axis is at an angle of no more than 45 degrees. An angle (55) of less than 45 degrees is appropriate as it permits tipping of the combination in a controlled fashion about the first pivot point (60) but prevents tipping of the combination about the second pivot point (62) unless additional force is exerted on the combination by the individual. The second pivot point (62) is adapted to pivot the bottle bolder and bottle combination from the stable intermediate position to a third pouring position.

In FIG. 7, the individual applies additional forces through the arm (37) and forces the combination to rotate about the second pivot point (62) to a pouring position. In the pouring position, the combination can be easily controlled by arm strength between an angle of greater than 45 degrees but less than 90 degrees from the vertical to permit the contents of the bottle to be poured into a receptacle (65). Of equal importance is the reverse operation whereby the individual is able to move the combination back to a vertical position by first pivoting the combination about second pivot point (62) to a stable intermediate position and then pivot the combination about the first pivot point (60) to the vertical position.

Figure 8:
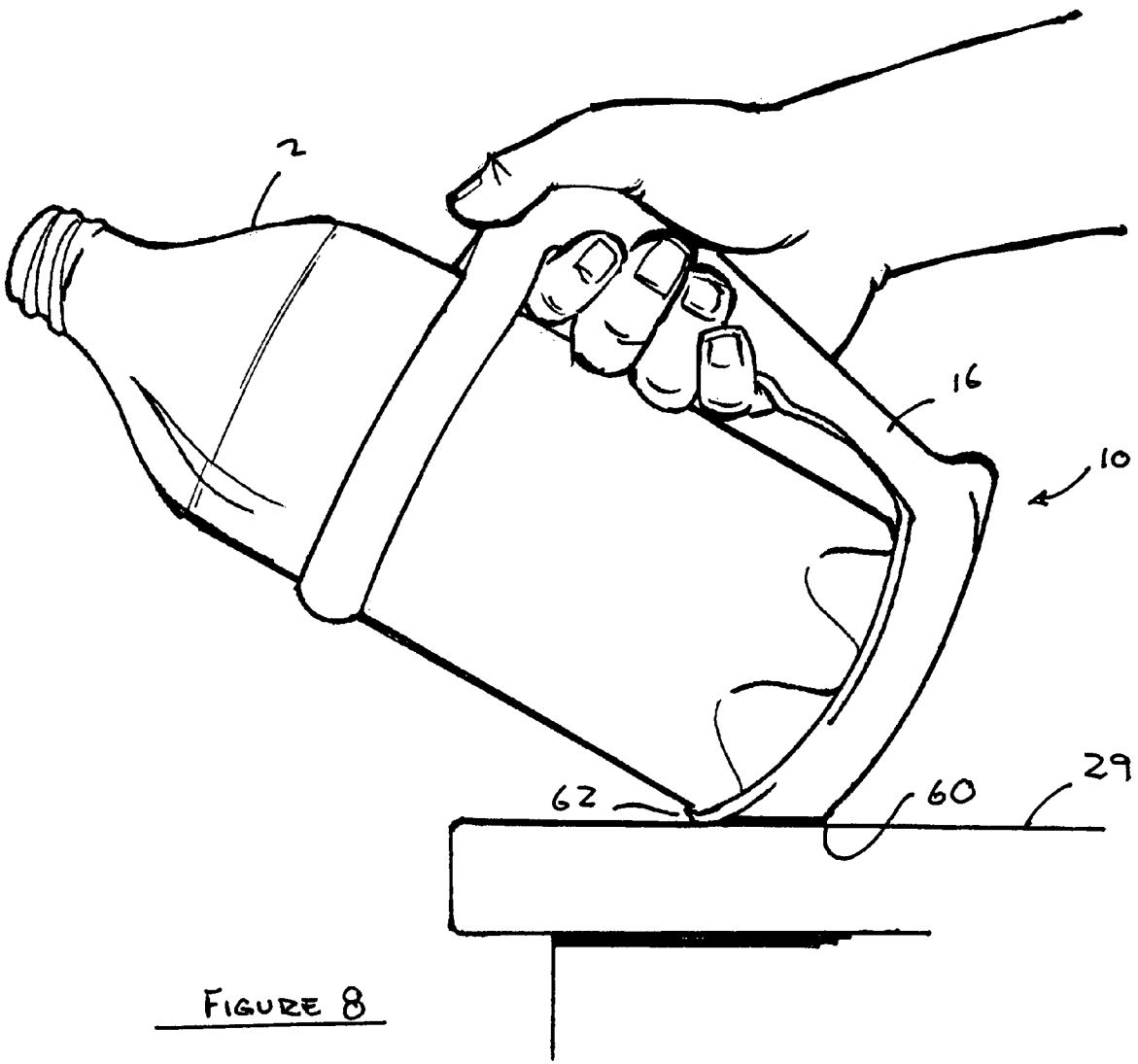
FIG. 8 is a side view of the same embodiment of the invention as FIGS. 5, 6 and 7 showing the combination bottle holder and bottle manipulated by a hand in a pistol-grip grasp about the handle.

Referring now to FIG. 8, the same step-wise pouring process described with reference to FIGS. 5, 6, and 7 can be used when the bottle holder is gripped in a pistol-grip fashion.

Figure 9:
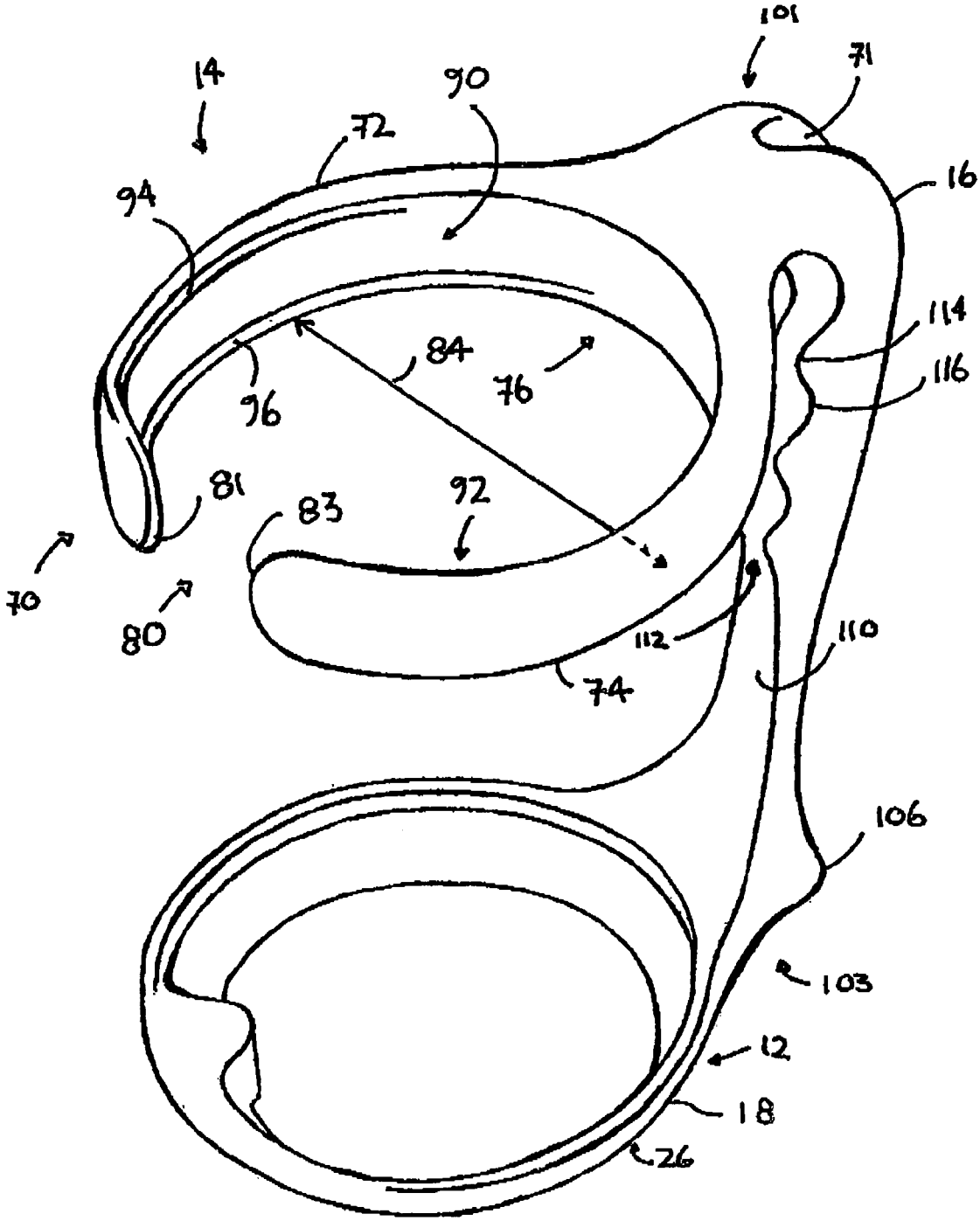
FIG. 9 is the same embodiment of the invention as FIG. 2.

Referring now to FIG. 1 and FIG. 9, bottle grasping means (14) is adapted to firmly grasp the bottle and hold it within bottle holder. Grasping means (14) comprises an open ring (70) having an open front end thereby forming gap (80). The open ring is defined by a first arcuate arm (72) and a second arcuate arm (74). The arms (72) and (74) are incurvate upon each other. The back portion (76) of the ring (70) is fixed to the top end of the handle (16) and cohesive therewith. The tips (81) and (83) respectively of arms (72) and (74) are in a confronting relationship with gap (80) between them. The inner diameter (84) of ring (70) is slightly smaller than the diameter of the bottle it is intended to hold so that when a bottle is placed within the ring the arms will have an inherent tendency to flex outwardly to accommodate the slightly larger diameter of the bottle. Once the bottle is inserted within ring (70) the arms will exert a compressive force against the outside surface of the bottle thereby firmly grasping it.

Figure 10:
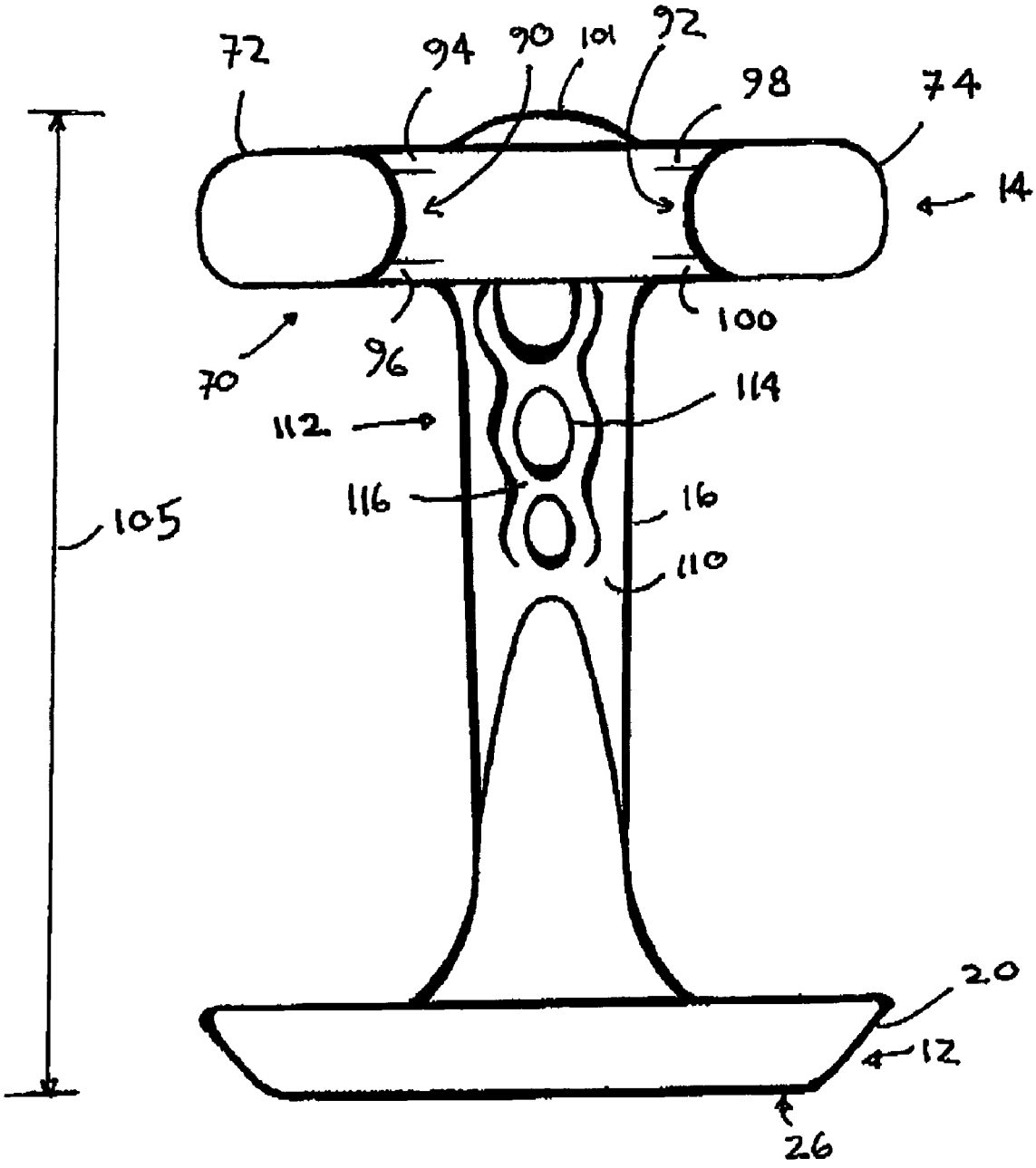
FIG. 10 is a front view of one embodiment of the invention.

Referring to FIG. 9 and FIG. 10, the inside surfaces (90) and (92) of arms (72) and (74) include raised contact surfaces (94), (96), (98) and (100) that are molded into the inside surfaces of the arms. These contact surfaces concentrate the compressive grasping forces from the arms onto the bottle to further enhance stability of the bottle within the holder.

Figure 11:
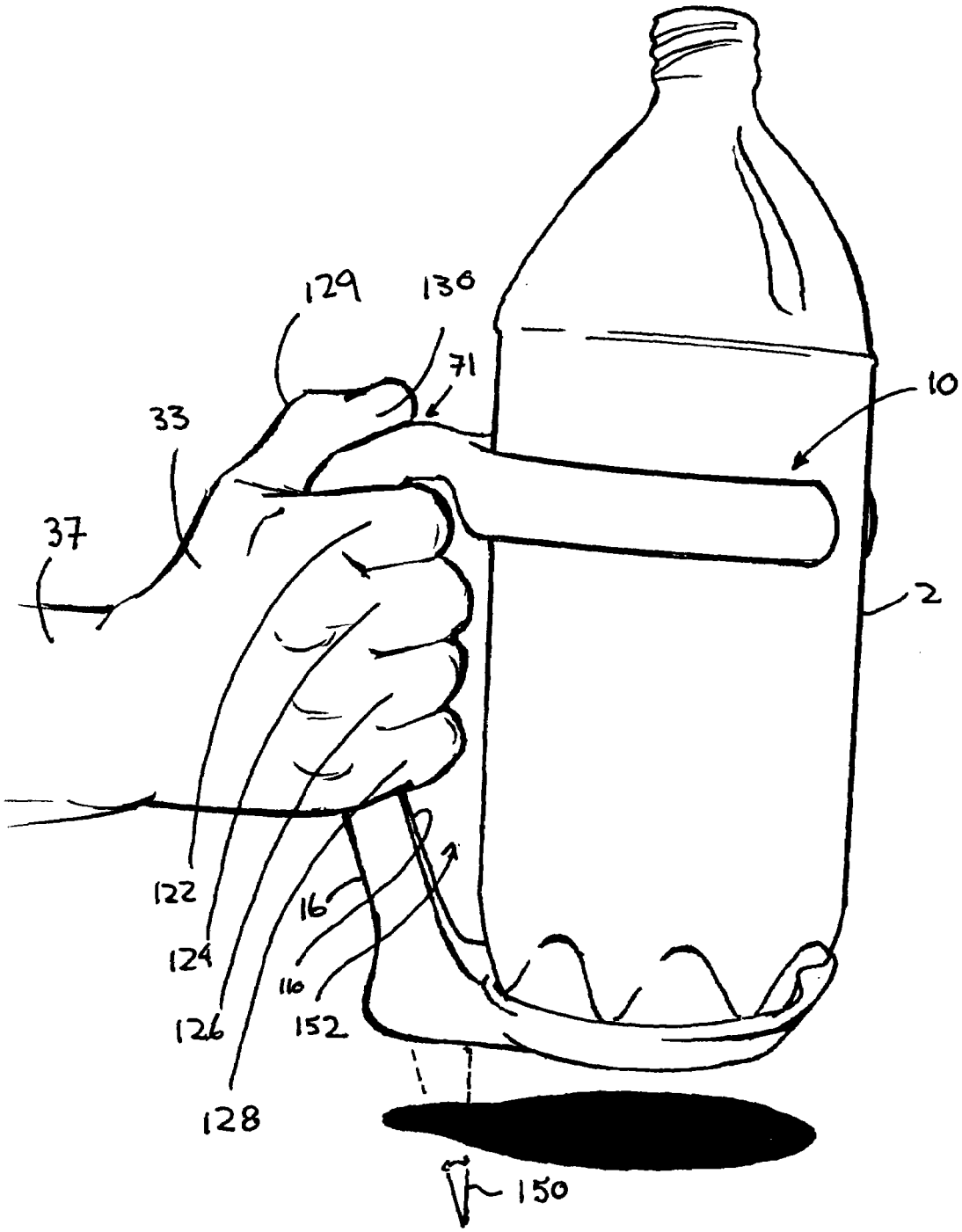
FIG. 11 is one embodiment of the invention showing the pistol-grip method of lifting the bottle and bottle holder combination.

Still referring to FIG. 9 and FIG. 10 handle (16) is described. Handle (16) has been ergonomically designed to permit manipulation of the combined bottle and bottle holder by a person with weakened hand strength caused by disease, accident or aging in a slide-grip as shown in FIG. 5 or in a pistol-grip fashion as shown in FIG. 11. Handle (16) is a rigid member joining the base (12) and grasping means (14). The length of the handle (105) is sufficient to permit the hand to grasp the handle as shown in FIG. 11 in a pistol-grip fashion and to permit the bottle grasping means (14) to contact the bottle held within the bottle holder at a point near centre of gravity of a full bottle for stability. The top end (101) of the hand member handle member (16) includes a notch (71) adapted to accommodate the curved profile of a human thumb pad which facilitates grasping and manipulation of the beverage bottle holder. The bottom end (103) of the handle includes a chin-shaped projection (106) about one inch in length along the X-axis. The bottom surface of the projection is flat and contiguous with the bottom surface (26) of collar (18). The purpose of the projection is to ensure stability about the axis of the battle and bottle holder combination by preventing a pivoting action about the bottom end (103) of the handle when the bottle is returned to an upright position. For example, as described previously, and referring to FIG. 5. when the bottle is returned from a pouring position to a vertical position, the individual with weak hand strength may not be able to adequately control the bottle as it pivots about first pivot point (60) back to the vertical position. Therefore, the projection (104) exists to ensure that the combination bottle and bottle holder does not rotate backwards about the bottom of the handle.

Referring to FIGS. 9 and 10, the handle (16) inside surface (110) includes a gripping surface (112) that includes a plurality of aligned alternating raised areas (114) and hollows (116) of diminishing size from top to bottom that are adapted to conform to the circumference of an individual's fingers when gripped in a pistol grip fashion as illustrated in FIG. 11. In the pistol gripping mode the palmal sides of the index (122), middle (124), ring (126) and small (128) fingers are in comfortable contact with the hollows and the thumb pad (130) is in contact with groove (71). The inside surface of the handle is sufficiently wide to comfortably distribute the weight of the bottle and bottle holder combination across the dorsal side of the individual's fingers.

Figure 12:
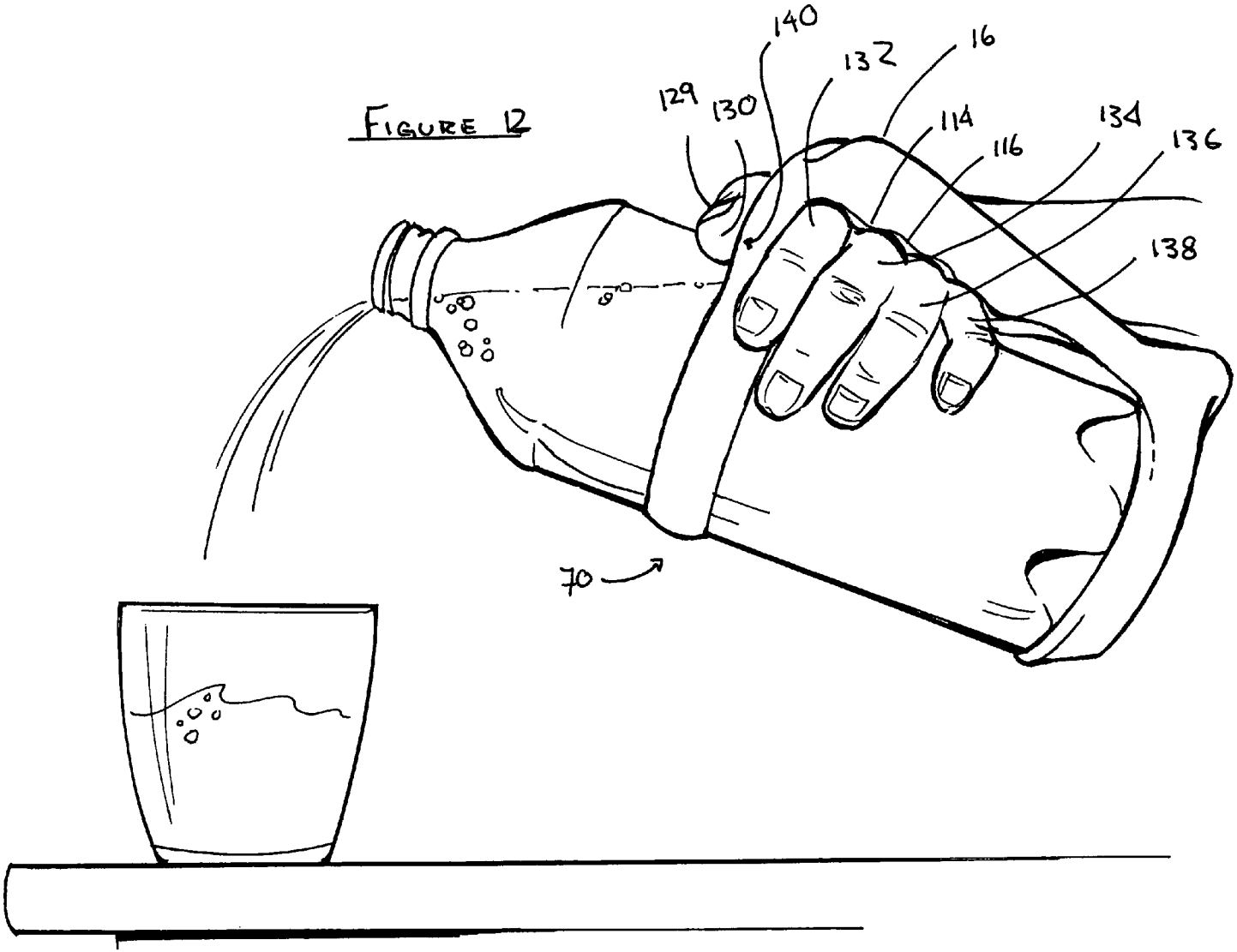
FIG. 12 is one embodiment of the invention showing the slide-grip method of lifting the bottle and bottle holder combination.

Referring to FIG. 12, the raised areas (114) and hollows (116) are also adapted to conform to dorsal side of an individual's fingers when the bottle holder and bottle combination is being manipulated in a slide-grip fashion. In this gripping mode the dorsal side of the base of the metacarpals (132), (134), (136) and (138) of each finger is in contact with the hollows with the carpals (knuckles) (not shown) acting as an abutment against the grip. The thumb pad (130) is positioned at (140) on top of the handle at the point where ring (70) joins the handle (16). To reduce stress in the thenar muscles between the thumb and the index finger (122) that control the thumb (129), ring (70) is joined to the handle at a point slightly below the top (101) of the handle. This is illustrated in FIG. 10, where the top crest (101) of the handle is shown rising slightly above the back of ring (70). Being able to use a slide grip permits the lifting and manipulation of a bottle and bottle holder combination as the weight of the bottle is carried on the dorsal side of the hand and no grasping is required to control the bottle.

Referring back to FIG. 11, the handle (16) possesses an acclivity (150) that creates a void (152) between the inside surface (110) of the handle (16) and the outside surface of the bottle (2) to permit the fingers of a person's hand to grasp the handle in either a pistol-grip or slide-grip fashion. The acclivity (150) is generally less than 30 degrees from the vertical but may be more or less in other possible embodiments of the invention.

The bottle holder is manufactured by means of known injection molding techniques using known light weight and resilient plastic materials that are capable of maintaining their resiliency when under cold temperatures. Injection molding permits easy and inexpensive manufacturing of the invention.

The invented bottle holder and bottle and bottle holder combination are applicable in any situation where the gripability and ability to manipulate of a large plastic beverage bottle needs to be augmented. It is advantageously applicable in situations where persons who have weakened hand strength and motor skills need to manipulate large plastic beverage bottles.

Although this description contains much specificity, these should not be construed as limiting the scope of the invention by merely providing illustrations of some of the embodiment of the invention. Thus the scope of the invention should be determined by the appended claims and their legal equivalents rather than by the examples given.

What is claimed is:

1. A beverage bottle holder for holding a plastic beverage bottle having a bottom and a diameter, said bottom comprising a plurality of evenly cusped configurations constituted by inward wall portions and outwardly projecting wall portions forming inward sloping legs, said beverage bottle holder having a front and a back and comprising: a. a base adapted to accept and firmly seat the bottom of the bottle, wherein said base comprises: i. a collar having an annulus, a height, an inside wall, an outside wall including a front end having a sloped linear surface, a flat top surface and a flat bottom surface; ii. at least one sinusoidal cusp projecting radially inwards from said collar inside wall and cohesive therewith; iii. a first pivot point; and; iv. a second pivot point, b. bottle grasping means for firmly grasping the bottle within the bottle holder; and, c. a rigid handle member having a top end and a bottom end, said handle member fixed between said base and said grasping means.

2. The beverage bottle holder as claimed in claim 1, wherein said annulus has a first bottom inside diameter and a second top inside diameter and further wherein said first bottom inside diameter is less than said second top inside diameter causing said collar outside wall to have a slope of less than 45 degrees.

3. The beverage bottle holder as claimed in claim 2, wherein said collar inside wall has a first inward sloped portion adapted to receive the inward sloping legs of the bottle and a second vertical portion adapted to guide the inward sloping legs of the bottle into said first inward sloped portion.

4. The beverage bottle holder as claimed in claim 3, wherein said at least one sinusoidal cusp has a flat bottom surface contiguous with said collar flat bottom surface, a flat top surface contiguous with said collar flat top surface, a height equal to said collar height and a width and further wherein the at least one sinusoidal cusp is adapted to mesh with at least one of said inward wall portions on the bottom of the bottle thereby preventing rotation of the bottle within the holder.

5. The beverage bottle holder as claimed in claim 4 wherein the collar inside wall includes a plurality of sinusoidal cusps projecting radially inwards.

6. The beverage holder as claimed in claim 5 wherein said plurality of sinusoidal cusps projecting radially inwards; is equal to said plurality of evenly cusped configurations.

7. The beverage bottle holder as claimed in claim 1, wherein said first pivot point and said second pivot point are located at the collar outside wall front end, and wherein the first pivot point is located at the bottom of the collar outside wall front end, and further wherein the second pivot point is located at the bottom of the collar outside wall front end.

8. The beverage bottle holder as claimed in claim 7, wherein the first pivot point is adapted to pivot the bottle holder from a first vertical position to a second inclined position having an incline of less than 45 degrees from the vertical and further wherein said second inclined position the bottle holder rests stably the sloped linear surface of the front outside wall of the collar.

9. The beverage bottle holder as claimed in claim 8, wherein the second pivot point is adapted to pivot the bottle holder from said second inclined position to a third pouring position having an incline of less than 90 degrees but more than 45 degrees.

10. The beverage bottle holder as claimed in claim 1, wherein said bottle grasping means for firmly grasping the bottle within the bottle holder comprises a ring having an inner diameter, a gapped front and a closed a back fixed below said handle top end.

11. The beverage bottle holder as claimed in claim 10, wherein said ring is defined by a first arcuate arm and a second arcuate arm, and wherein said first arcurate arm and said second arcuate arm are incurvate upon each other and have an inherent resiliency, and further wherein the first arcuate arm and the second arcuate arm include first and second tips respectively, said tips having a confronting relationship thereby forming said gapped ring front.

12. The beverage bottle holder as claimed in claim 11, wherein the ring is adapted to exert compressive forces against the bottle thereby firmly grasping it.

13. The bottle holder as claimed in claim 12, wherein the first arcuate arm and the second arcuate arm each include a pair of raised parallel contact surfaces molded on the inside surfaces thereof for concentrating said compressive forces.

14. The beverage bottle holder as claimed in claim 1, wherein, said rigid handle member comprises: a. an inside surface comprising a gripping surface; b. a notch included within said top end, said notch curved to accommodate the curved profile of a human thumb pad; and, c. a chin-shaped projection at said bottom end extending from the back thereof, said projection having a bottom surface contiguous with the bottom surface of the collar wherein the projection is adapted to prevent backward rotation of the bottle holder.

15. The beverage bottle holder as claimed in claim 14, wherein the handle possesses an acclivity extending away from the base thereby creating a void between the inside surface of the handle and a bottle carried within the bottle holder so that a hand may be slid between the handle and the bottle.

16. A beverage bottle holder and plastic beverage bottle combination, said bottle having a bottom and a diameter, said bottom comprising a plurality of evenly cusped configurations constituted by inward wall portions and outwardly projecting wall portions forming inward sloping legs, said combination having a front and a back, wherein said holder comprises: a. a base accepting and firmly seating the bottom of the bottle, wherein said base comprises: i. a collar having an annulus, a height, an inside wall, an outside wall including a front end having a sloped linear surface, a flat top surface and a flat bottom surface; ii. at least one sinusoidal cusp projecting radially inwards from said collar inside wall and cohesive therewith; iii. a first pivot point; and; iv. a second pivot point; b. bottle grasping means firmly grasping the bottle within the bottle holder; and, c. a rigid handle member having a top end and a bottom end, said handle member fixed between said base and said grasping means.

17. The combination as claimed in claim 16, wherein said annulus has a first bottom inside diameter and a second top inside diameter and further wherein said first bottom inside diameter is less than said second top inside diameter causing said collar outside wall to have a slope of less than 45 degrees.

18. The combination as claimed in claim 17, wherein said collar inside wall has a first inward sloped portion receiving the inward sloping legs of the bottle and a second vertical portion guiding the inward sloping legs of the bottle into said first inward sloped portion.

19. The combination as claimed in claim 18, wherein said at least one sinusoidal cusp has a flat bottom surface contiguous with said collar flat bottom surface, a flat top surface contiguous with said collar flat top surface, a height equal to said collar height and a width and further wherein the at least one sinusoidal cusp meshes with at least one of said inward wall portions on the bottom of the bottle thereby preventing rotation of the bottle within the holder.

20. The combination as claimed in claim 19, wherein the collar inside wall includes a plurality of sinusoidal cusps projecting radially inwards.

* * * * *